US009845928B1

(12) United States Patent
Tyson et al.

(10) Patent No.: US 9,845,928 B1
(45) Date of Patent: Dec. 19, 2017

(54) IN-GROUND LIGHTING WITH EXTERNAL OPTICS AIMING SYSTEM

(71) Applicant: U.S.T.E., Inc., Simi Valley, CA (US)

(72) Inventors: Glenn M. Tyson, La Crescenta, CA (US); Michael P. Leonhardt, Castaic, CA (US)

(73) Assignee: U.S.T.E., Inc., Simi Valley, CA (US)

( * ) Notice: Subject to any disclaimer, the term of this patent is extended or adjusted under 35 U.S.C. 154(b) by 54 days.

(21) Appl. No.: 15/136,823

(22) Filed: Apr. 22, 2016

(51) Int. Cl.

| | |
|---|---|
| ***F21V 14/00*** | (2006.01) |
| ***F21V 29/83*** | (2015.01) |
| ***F21V 29/74*** | (2015.01) |
| ***F21S 8/00*** | (2006.01) |
| ***F21V 29/15*** | (2015.01) |
| ***F21V 7/00*** | (2006.01) |
| ***F21V 14/08*** | (2006.01) |
| ***F21V 31/00*** | (2006.01) |
| ***F21V 23/00*** | (2015.01) |
| *F21Y 101/02* | (2006.01) |

(52) U.S. Cl.
CPC ..... *F21S 8/032* (2013.01); *F21V 7/00* (2013.01); *F21V 14/08* (2013.01); *F21V 23/003* (2013.01); *F21V 29/15* (2015.01); *F21V 29/74* (2015.01); *F21V 29/83* (2015.01); *F21V 31/005* (2013.01); *F21Y 2101/02* (2013.01)

(58) Field of Classification Search
CPC .... F21S 8/02; F21S 8/022; F21S 8/024; F21S 8/026; F21S 8/032; F21S 10/00; F21S 10/007; F21S 10/06; F21S 10/063; F21V 5/002; F21V 7/0025; F21V 5/008; F21V 14/02; F21V 14/05; F21V 14/06; F21V 14/08; F21V 29/004; F21V 29/83; F21V 33/0088; B64F 1/205
USPC ..... 362/480, 294, 345, 373, 547, 269, 282, 362/285
See application file for complete search history.

(56) References Cited

U.S. PATENT DOCUMENTS

| | | | | |
|---|---|---|---|---|
| 5,056,902 | A | 10/1991 | Chinnock et al. | |
| 6,068,384 | A | 5/2000 | Tyson et al. | |
| 7,690,816 | B2 | 4/2010 | Tyson et al. | |
| 7,997,774 | B2 | 8/2011 | Liddle | |
| 8,567,999 | B2 * | 10/2013 | Paik | F21S 48/328 362/257 |
| 9,109,760 | B2 | 8/2015 | Shum et al. | |
| 2008/0123341 | A1 * | 5/2008 | Chiu | F21K 9/233 362/294 |
| 2009/0284975 | A1 | 11/2009 | Querci | |
| 2014/0146545 | A1 | 5/2014 | Shum et al. | |
| 2016/0018085 | A1 * | 1/2016 | Van Thiel | F21V 17/02 362/268 |
| 2017/0211247 | A1 * | 7/2017 | Messiou | E01F 9/559 |

* cited by examiner

*Primary Examiner* — Suezu Ellis
(74) *Attorney, Agent, or Firm* — Knobbe, Martens, Olson & Bear, LLP

(57) ABSTRACT

An in-grade light fixture is provided with a corrugated housing design. The corrugated housing design enhances structural integrity and the flow of air within the light fixture to facilitate cooling. The light fixture includes an annular door with slots aligned with the corrugations to facilitate the influx of cool air into the housing and the exhaust of hot air from the housing. The light fixture includes a hot-aiming system that allows a tilt optic to be rotated via magnetic force within the light fixture using an external instrument, such as magnetic wand. The beam direction can be rotated using this hot-aiming system without opening the light fixture.

20 Claims, 16 Drawing Sheets

IN-GROUND LIGHTING WITH EXTERNAL OPTICS AIMING SYSTEM

BACKGROUND

Field

The present disclosure generally relates to in-ground light fixtures and more particularly to in-ground light fixtures with improved structural strength, air flow, and beam aiming capabilities.

Description of Related Art

Outdoor lighting can be used for enhancing the aesthetics and/or safety of a location. Light fixtures can be configured to be installed in different locations and to serve a number of different purposes. For example, light fixtures can be installed to illuminate structures, gardens, parks, parking lots, and the like. When installed in rugged or harsh environments, for example, light fixtures can include features to enhance the reliability and durability of the fixture including strength reinforcements, water drainage, cooling features, and the like. In addition, to provide desired lighting conditions, fixtures can include features to provide a desired light output such as color temperature, beam shape, beam direction, and the like. Typically, to change the aiming direction of the beam, a light fixture would have to be at least partially disassembled to alter the optical components of the light fixture. This process can be difficult, laborious, and time-consuming, particularly for adjusting the aiming direction of in-grade lighting fixtures while the light source is on. In addition, partially disassembling the light fixture may weaken seals between components, potentially allowing water or other debris to enter the light fixture in places where it is undesirable.

SUMMARY

Embodiments described herein have innovative aspects, no single one of which is indispensable or solely responsible for their desirable attributes. Without limiting the scope of the disclosure and/or claims, some of the advantageous features will now be summarized.

In a first aspect, a light fixture is provided that includes a fixture housing with a door support and an optic assembly support. The light fixture also includes an annular door supported by the door support of the fixture housing. The light fixture also includes an optic assembly having a reflector and a light source. The optic assembly is supported by the optic assembly support of the fixture housing. The light source is positioned at a distal end of the optic assembly and configured to provide a light beam that is at, least partially shaped and redirected by the reflector. The light fixture also includes a rotatable tilt optic that has an aiming magnet attached thereto. The rotatable tilt optic is supported by a proximal portion of the optic assembly such that at least a majority of the light beam provided by the light source passes through the rotatable tilt optic. The light fixture includes an optical element supported by the annular door such that at least a majority of the light beam that passes through the rotatable tilt optic passes through the optical element as well. The light fixture is configured so that application of a magnetic force to the aiming magnet causes the rotatable tilt optic to rotate within the light fixture to change an angle of the light beam exiting the light fixture without opening the light fixture.

In some embodiments of the first aspect, the rotatable tilt optic further includes an aiming indicator to indicate a direction of the light beam exiting the light fixture. In some embodiments of the first aspect, the aiming magnet extends at least partially around a periphery of the rotatable tilt optics. In some embodiments of the first aspect, the rotatable tilt optics is configured to rotate 360 degrees within the light fixture.

In some embodiments of the first aspect, the fixture housing comprises corrugations configured to provide structural integrity to the light fixture. In some embodiments of the first aspect, the fixture housing comprises corrugations configured to facilitate air flow through the light fixture. In, further embodiments, the annular door includes exterior slots substantially aligned with outward corrugations of the fixture housing to facilitate ingress of air from the environment into the fixture housing. In yet further embodiments, the annular door includes interior slots substantially aligned with inward corrugations of the fixture housing to facilitate egress of air from the fixture housing into the environment. In yet further embodiments, the optic assembly includes flow through openings substantially aligned with the interior slots of the annular door to facilitate egress of air from the fixture housing into the environment.

In some embodiments of the first aspect, the light fixture further includes control electronics in an enclosure in thermal contact with the optic assembly, the control electronics being thermally insulated from the optic enclosure.

In a second aspect, a light fixture is provided that includes a fixture housing. The fixture housing includes inward corrugations, outward corrugations, a door support, and an optic assembly support. The light fixture includes an annular door supported by the door support of the fixture housing. The annular door includes exterior slots substantially aligned with the outward corrugations of the fixture housing and interior slots substantially aligned with the inward corrugations of the fixture housing. The light fixture includes an optic assembly supported by the optic assembly support of the fixture housing. The optic assembly includes flow through openings substantially aligned with the interior slots of the annular door, a reflector, and a light source. The light fixture includes an optical element supported by the annular door. The light fixture is configured so that cooling of components of the optic assembly is provided by air flowing into the light fixture through the exterior slots of the annular door and out through the interior slots of the annular door.

In some embodiments of the second aspect, the optic assembly further comprises a rotatable tilt optic, the rotatable tilt optic comprising an aiming magnet attached thereto, the rotatable tilt optic supported by a proximal portion of the optic assembly. In further embodiments, application of a magnetic force to the aiming magnet causes the rotatable tilt optic to rotate within the light fixture to change an angle of a light beam exiting the light fixture without opening the light fixture. In further embodiments, the rotatable tilt optic further comprises an aiming indicator to indicate a direction of the light beam exiting the light fixture. In further embodiments, the aiming magnet extends at least partially around a periphery of the rotatable tilt optic.

In some embodiments of the second aspect, the optic assembly further comprises radial fins to increase heat transfer to air flowing through the light fixture. In some embodiments of the second aspect, the optic assembly is in thermal contact with the annular door such that heat is conducted from the optic assembly to the annular door. In some embodiments of the second aspect, the inward corrugations and the outward corrugations extend substantially the entire length of the fixture housing from the door support to a distal end of the fixture housing. In a further embodiment, the inward corrugations and the outward corrugations are configured to provide structural integrity to the light fixture sufficient to withstand a vehicle driving over the light fixture when installed in the ground.

In some embodiments of the second aspect, the light fixture further includes control electronics in an enclosure in thermal contact with the optic assembly, the control electronics being thermally insulated from the optic enclosure.

BRIEF DESCRIPTION OF THE DRAWINGS

Aspects and advantages of the embodiments provided herein are described with reference to the following detailed description in conjunction with the accompanying drawings. Throughout the drawings, reference numbers may be re-used to indicate correspondence between referenced elements. The drawings are provided to illustrate example embodiments described herein and are not intended to limit the scope of the disclosure.

DETAILED DESCRIPTION

Generally described, aspects of the present disclosure relate to in-grade light fixtures that have increased structural strength, increase air flow for cooling, and/or an external hot-aiming system that allows the beam direction to be changed without opening the light fixture. The disclosed light fixtures generally comprise a fixture housing and an optic assembly with features and components that together provide the advantages and capabilities described herein. The fixture housing can be corrugated to enhance structural integrity and to enhance airflow in the fixture. The optic assembly can include features that cooperate with the fixture housing to enhance airflow in the fixture. The optic assembly can also include optical components that tilt the beam in a targeted direction and these optical components can be easily rotated to change the beam direction without opening the fixture. This external hot-aiming system can use one or more magnets attached to a tilt optic such that an external magnet, such as a magnetic wand, can be brought in proximity to the magnets attached to the tilt optic to move or rotate the tilt optic while the light beam is on. Advantageously, this can allow the beam direction to be changed without opening the light fixture. Furthermore, the disclosed light fixtures include structural features that advantageously increase the strength of the light fixture as well as increase airflow to maintain a desired or targeted temperature inside the fixture. This can increase the durability and reliability of the disclosed light fixtures.

Although examples and implementations described herein focus, for the purpose of illustration, on heavy duty, in-grade light fixtures, the disclosed features and advantages can also be integrated into light fixtures that are configured for use in different environments and for different purposes. Various aspects of the disclosure will now be described with regard to certain examples and embodiments, which are intended to illustrate but not limit the disclosure.

Figure 1A:
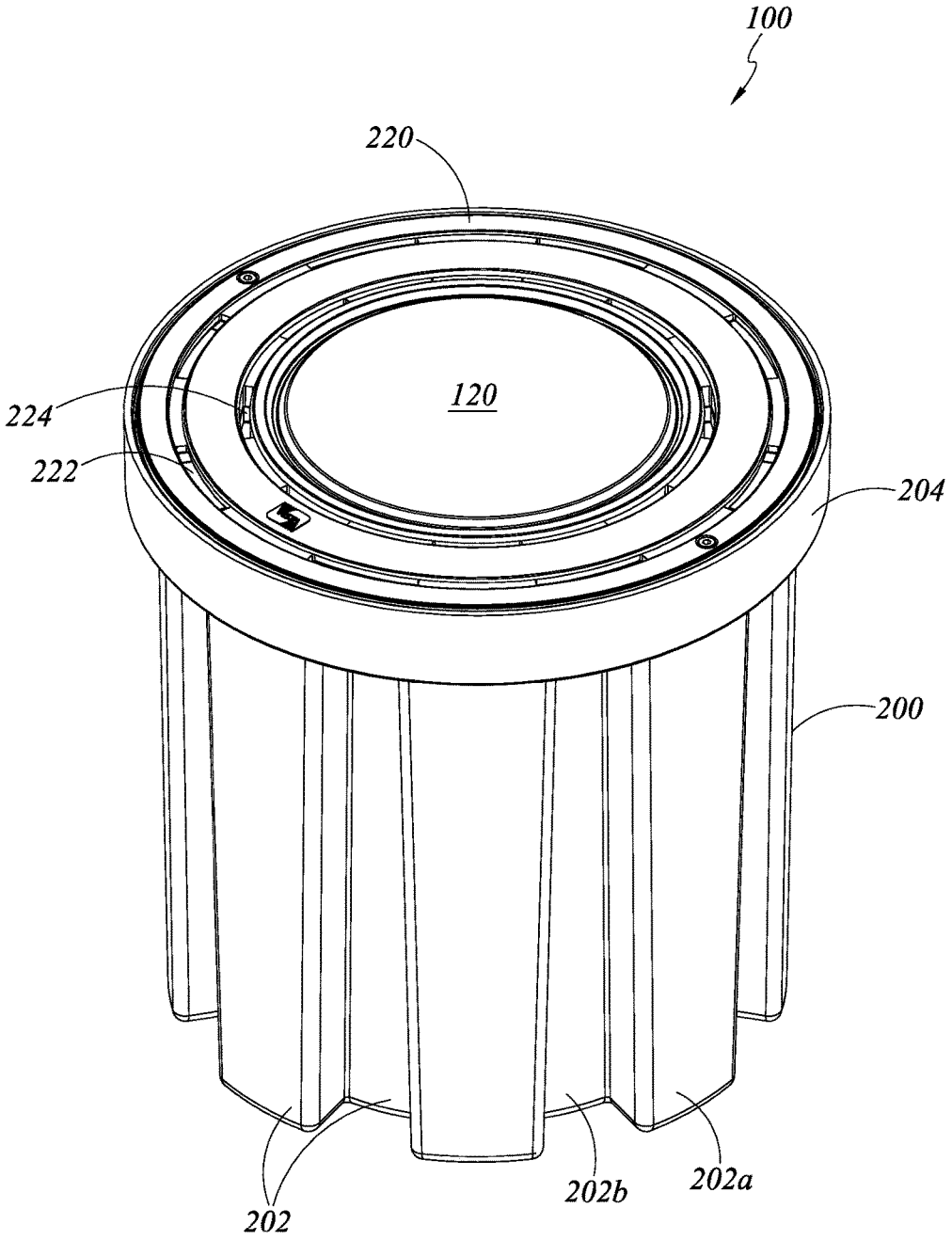
FIG. 1A illustrates a perspective vie of an example light fixture assembly with a corrugated fixture housing.
Figure 1B:
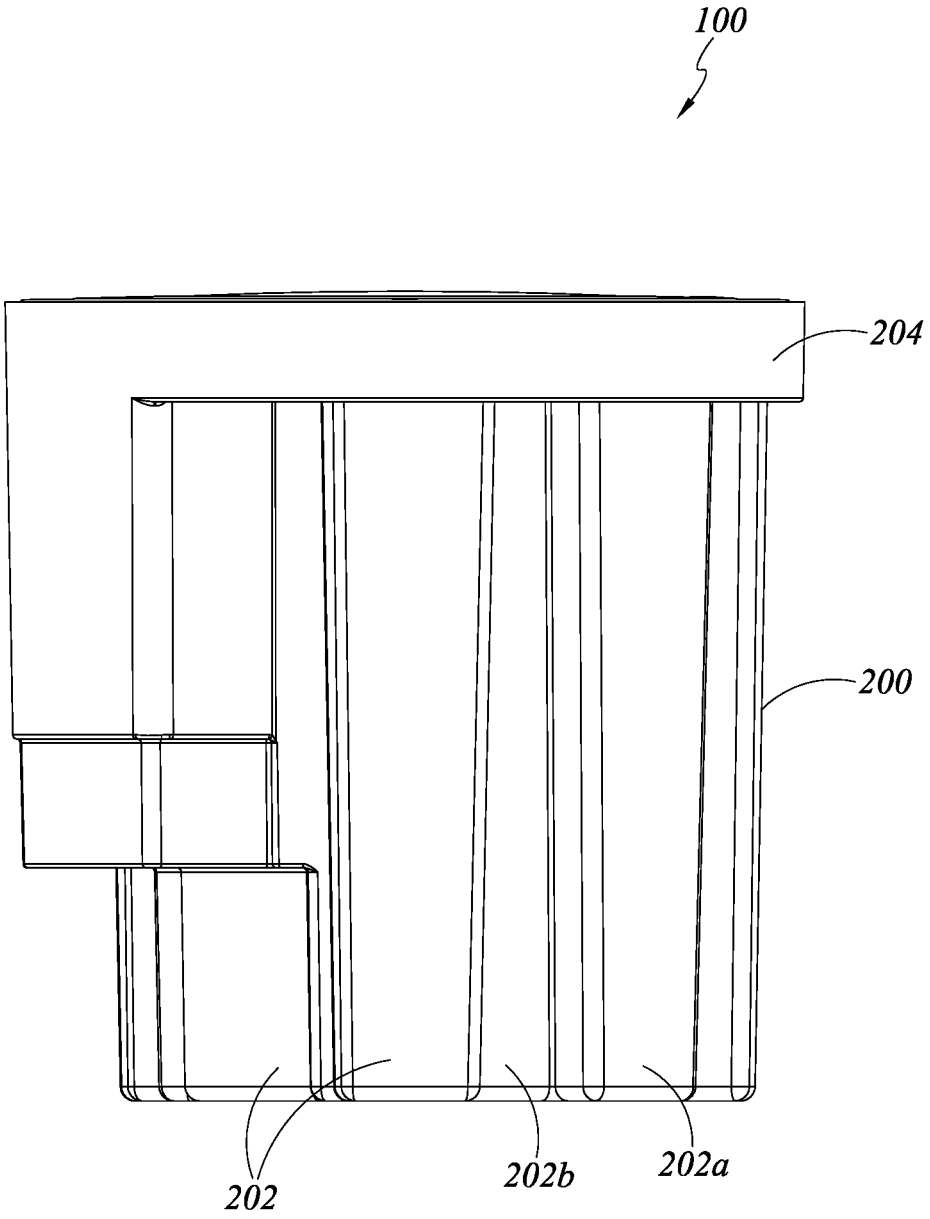
FIG. 1B illustrates a side view of the example light fixture assembly of FIG. 1A.
Figure 1C:
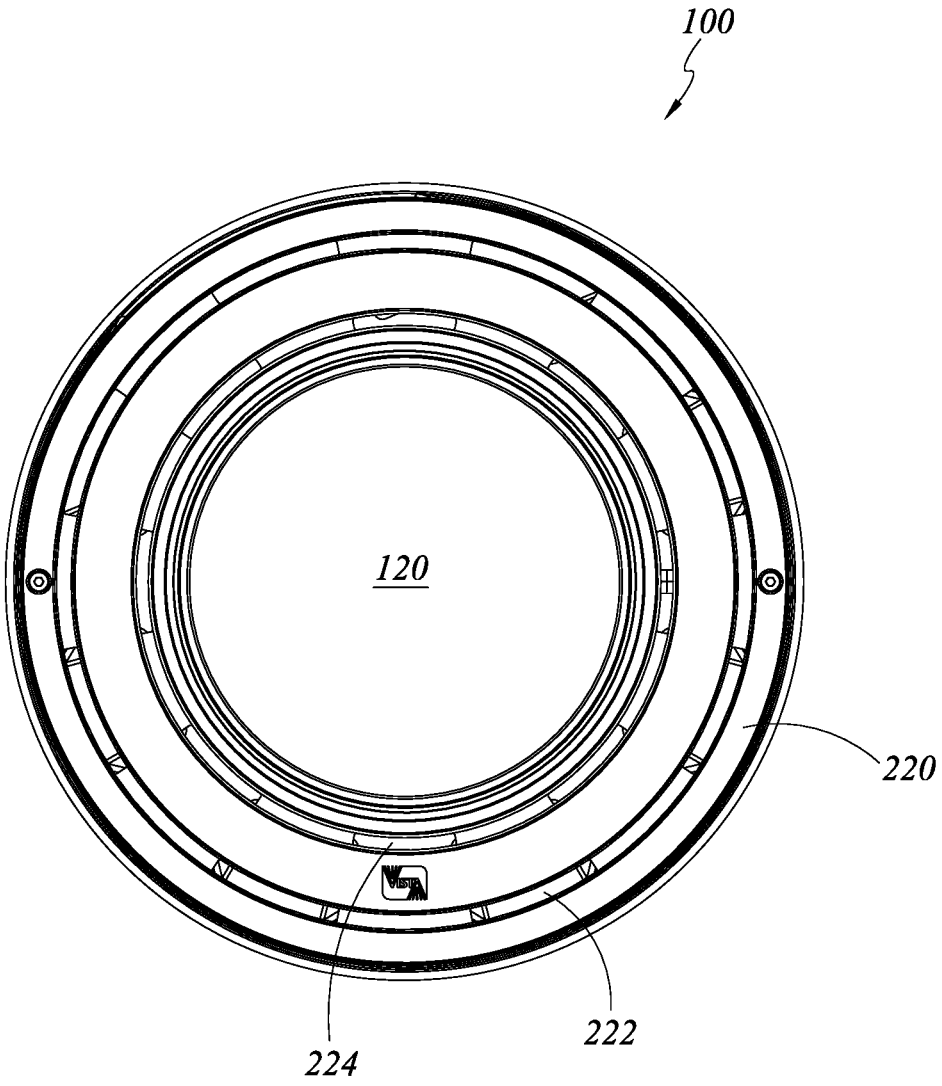
FIG. 1C illustrates a top view of the example light fixture assembly of FIG. 1A.

FIGS. 1A-1C illustrate different views of an example light fixture assembly 100 with a corrugated fixture housing 200. The fixture housing 200 can be generally cylindrical (e.g., the cross-section of the fixture housing 200 can be generally circular), as illustrated, but the fixture housing 200 may also conform to a number of different suitable shapes such as a housing having a cross-section that substantially conforms to a rectangle, an oval, or to any other polygon. In some embodiments, the fixture housing 200 can be a compression-molded, glass reinforced polymer. Other materials such as cast aluminum or bronze may also be contemplated. In some embodiments, the fixture housing 200 can comprise a unibody construction to enhance the structural integrity of the housing.

The corrugated fixture housing 200 can include corrugations 202 that extend radially outward, or outward corrugations 202*a*, and corrugations 202 that extend radially inward, or inward corrugations 202*b*. In some implementations, the outward corrugations 202*a* and/or inward corrugations 202*b* can be configured differently from the illustrated embodiment while still providing the described functionality and/or advantages. For example, the outward corrugations 202*a* and/or inward corrugations 202*b* can be configured to respectively extend outward and/or inward relative to any reference point of the fixture housing rather than explicitly extending radially outward and/or inward. As another example, where the fixture housing 200 has a different geometry (e.g., different from cylindrical such as rectangular, polygonal, ellipsoid, etc.), the outward corrugations 202*a* and/or inward corrugations 202*b* can be configured to respectively extend outward and/or inward relative to any reference point of the fixture housing 200 rather than explicitly being radially outward and/or inward.

The corrugations 202 of the fixture housing 200 can be configured to enhance or facilitate airflow within the light fixture assembly 100. As described in greater detail herein with reference to FIGS. 9 and 10, the corrugations 202 can cooperate with slots or openings 222, 224 in an annular door 220 as well as features of an optic assembly positioned within and supported by the fixture housing 200 to enhance or facilitate the flow of air into the fixture housing 200 and out of the fixture housing 200. This can enhance the thermal stability and/or cooling capabilities of the light fixture assembly 100 to protect the electrical components therein from overheating.

The corrugations 202 of the fixture housing 200 can be configured to enhance the structural support of the light fixture assembly 100. The corrugations 202 of the fixture housing 200 can thus be configured to increase the overall strength and durability of the light fixture assembly 100. The fixture housing 200 can include a door support 204 at a top or proximal end of the fixture housing 200, wherein the corrugations 202 extend distally from the door support 204. The corrugations 202 can thus provide additional support to the fixture housing when downward forces are applied to the annular door 220 as these forces can be distributed across the door support 204 and through the walls of the corrugations 202. The corrugations 202 can be configured to form walls that extend from the door support 204 to the distal end of the fixture housing 200. The corrugated walls 202 can increase the structural integrity of the fixture housing, and increasing the length of the corrugated walls 202 can enhance their strength and effectiveness. In some embodiments, the corrugated walls 202 extend along a majority of the length of the fixture housing 200. In some embodiments, the length of the corrugated walls 202 is equal to at least 70% of the total height of the fixture housing, at least 80% of the total height of the fixture housing, or at least 90% of the total height of the fixture housing (where height is measured along a longitudinal axis of the fixture housing 200 and the total height of the fixture housing 200 is the length from the proximal end to the distal end of the fixture housing 200). Structural features of the fixture housing 200 are described in greater detail herein with reference to FIG. 11. As with the cross-section of the fixture housing 200, the annular door 220 can have any suitable shape and, in some implementations, the shape of the annular door 220 substantially matches the general shape of the cross-section of the fixture housing 200.

The light fixture assembly 100 can include an optical element 120 supported by the annular door 220 and/or an optic assembly positioned within the fixture housing 200. The optical element 120 can include a lens or other optically transparent element configured to pass light from within the light fixture assembly 100 to outside of the light fixture assembly 100. The optical element 120 can be configured to have one or more optical properties to alter the light leaving the light fixture assembly 100. For example, the optical element 120 can be a lens with a positive or negative optical power to affect the divergence and/or convergence of the exiting light beam. The optical element 120 can include one or more filters to affect the light beam, the one or more filters configured to, for example and without limitation, change the color of the light, shift the color of the light, affect the brightness of the light, affect the polarization of the light, or any combination of these or the like. The optical element 120 can include other features configured to shape the beam of exiting light. For example, the optical element 120 can include louvers, diffraction gratings, beam spreaders, mirrors, prisms, or the like. The optical element 120 can cooperate with a tilt optic positioned within the light fixture to provide desired light output characteristics. The tilt optic is described in greater detail herein. In some embodiments, the tilt optic includes a series of tilt optic lenses. In some embodiments, the optical element 120 and/or the tilt optic can be transparent or semi-transparent to provide substantial uniformity in light output.

Figure 2:
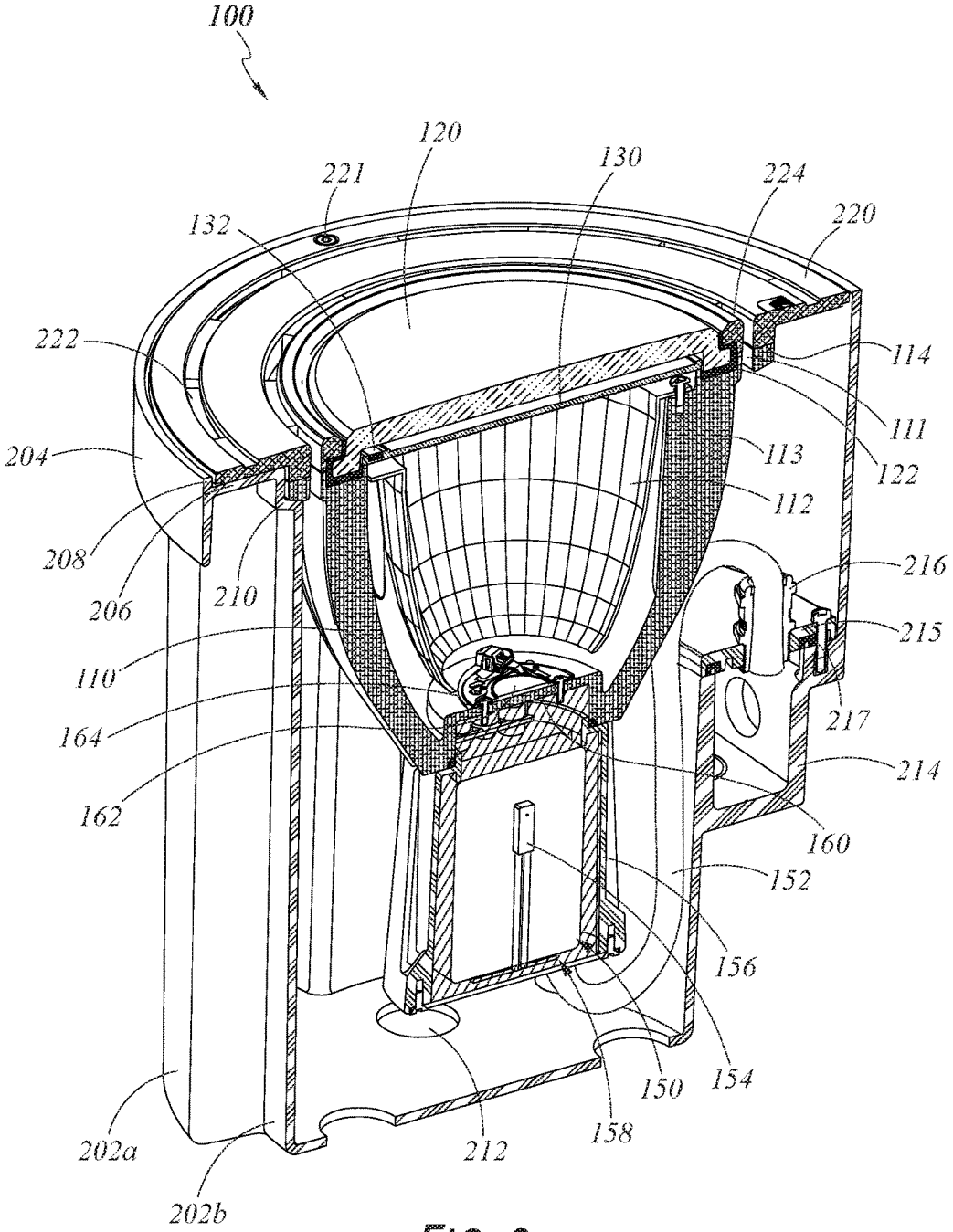
FIG. 2 illustrates a cross-sectional perspective view of an example light fixture assembly with a corrugated fixture housing, control circuitry, and an optic assembly with improved air flow and rotatable tilt optics.

FIG. 2 illustrates a cross-sectional perspective view of a light fixture assembly 100 with a corrugated fixture housing 200, control circuitry 150, and an optic assembly 110 with improved air flow and rotatable tilt optics 130. The light fixture assembly 100 can be configured to efficiently transfer thermal energy from inside the assembly to the environment through, slots 222, 224 and through conduction through the annular door 220. The light fixture assembly 100 can be configured to alter an aiming direction of exiting light through an aiming magnet 132 attached to the rotatable tilt optics 130. This can allow the direction of the light beam to be changed without opening the light fixture assembly 100. For example, the annular door 220 can remain fastened to the fixture housing 200 and/or optic assembly 110 while allowing the rotatable tilt optics 130 to be rotated using an external magnet to move the aiming magnet 132.

The light fixture assembly 100 includes the fixture housing 200 with corrugations 202 including outward corrugations 202*a* and inward corrugations 202*b*, as described herein in greater detail with respect to FIGS. 1A-1C and 11. With continued reference to FIG. 2, the fixture housing 200 includes door support 204 comprising flat surface 206 and door lip 208 that together form a seating for the annular door 220. The annular door 220 can be supported by the door support 204 and attached to it. In some embodiments, the annular door 220 can be die-cast aluminum or it can be cast stainless steel. The annular door 220 can be fastened to the door support 204 using fasteners 221, for example. The fasteners 221 can include screws, nuts, bolts, clips, clamps, or any other suitable fastener. The fixture housing 200 can include flow through openings 212 in the bottom or distal end of the fixture housing 200. The flow through openings 212 can be configured to allow water to exit the fixture housing 200 and/or to increase air flow in the housing 200, for example.

The light fixture assembly 100 includes the optic assembly 110 that is configured to support a reflector 112, a light source holder 164, the rotatable tilt optics 130, and the optical element 120. The optic assembly 110 can be supported by the fixture housing 200 on optical support 210 formed in the corrugations 202 of the fixture housing 200. The optical support 210 is described in greater detail herein with respect to FIG. 11. In some embodiments, the optic assembly 110 can be die-cast aluminum. In certain implementations, the optic assembly 110 and can include radial fins 113 to enhance heat dissipation of the optic assembly 110.

With continued reference to FIG. 2, the optic assembly 110 supports the reflector 112 which is configured to redirect light produced by a light source 162 through the tilt optics 130 and the optical element 120. The tilt optics 130 can be configured to redirect or otherwise affect the beam shape and/or beam direction exiting the light fixture assembly 100. The orientation of the tilt optics 130 can be modified through magnetic forces applied to the aiming magnet 132 attached to the tilt optics 130. For example, by applying a magnetic force to the aiming magnet 132, the rotatable tilt optics 130 can be forced to rotate within the optic assembly 110 to change a direction of the light beam exiting the light fixture assembly 100. Optical properties, functionality, and behavior of the tilt optics 130 are described in greater detail herein with reference to FIGS. 4-7.

With continued reference to FIG. 2, the light source 162 can be secured in the optic assembly 110 by the light source holder 164. The light source 162 can be driven by control electronics 150 which can include a light source driver module. In some embodiments, the light source 162 is an LED array and the control electronics 150 include an LED driver module. In certain implementations, the light source 162 can include a chip-on-board architecture, and can control color temperature. The control electronics 150 can be configured to control aspects of the light source 162 including, for example and without limitation, brightness and dimming. Electrical signals and electrical power can be delivered to the control electronics 150 using an electrical supply cable 152. The electrical supply cable 152 can carry electrical voltages from junction box 214 to the control electronics 150. In certain embodiments, the junction box 214 can be integrally molded in the fixture housing 200. The junction box 214 can be configured to be water tight through the use of water-tight seal 216, gasket 217, junction box lid 215, or other similar structures.

In some embodiments, at least a portion of the control electronics 150 can be positioned within an enclosure 156. The enclosure 156 can be a polymeric enclosure, in some implementations. The enclosure can include an epoxy 158 or other potting compound to protect the control electronics 150 from moisture and/or to thermally insulate the control electronics 150. The enclosure 156 can be in thermal contact with the optic assembly 110 at a heat dissipation plane 160 configured to substantially minimize the transfer of thermal energy between the enclosure 156 and the optic assembly 110. The enclosure 156 and the optic assembly 110 can be configured to be separately sealed from one another while being electrically connected.

In some embodiments, the control electronics 150 are electrically coupled to a thermal cutoff switch 154. The thermal cutoff switch 154 can be configured to control electrical power to the control electronics 150 (e.g., an LED driver module) and thereby to the light source 162. If a temperature of the thermal cutoff switch 154 exceeds a threshold temperature, the thermal cutoff switch 154 can be configured to turn off electrical power to the control electronics. This can advantageously reduce the likelihood that the control electronics 150 and/or light source 162 become damaged due to excessive heat in the light fixture assembly 100. In some embodiments, the thermal cutoff switch 154 includes a thermostat.

In some embodiments, the optic assembly 110 supports the annular door 220 at a thermal transfer interface 114. The thermal transfer interface 114 can be a planar or other similarly shaped extension of a proximal end of the optic assembly 110 that is configured to contact and/or support the annular door 220. At the thermal transfer interface 114, heat can be transferred from the optic assembly 110 to the annular door 220 to be radiated into the environment. This conduction of heat from the optic assembly 110 to the annular door 220 can enhance and/or facilitate thermal management (e.g., cooling) of the light fixture assembly 100. For example, this can allow heat generated by the light source 162 and/or control electronics 150 to be conducted through the optic assembly 110 to the annular door 220 to be radiated off into the environment. For example, the relatively large surface area of a proximal end of the optic assembly 110 is in intimate contact with the annular door 220, thereby allowing for efficient transmission of heat through conduction. The top surface of the annular door 220 can then dissipate that heat through radiation into the atmosphere. This may be especially advantageous where the light fixture assembly 100 is installed in the ground.

The optic assembly 110 can be coupled to the optical element 120 through an optical enclosure sealing gasket 122. The optical enclosure sealing gasket 122 can be configured to provide a substantially sealed interface between the optic assembly 110 and the optical element 120 to resist or prevent the introduce of dust, water, particles, or the like into optic assembly 110.

The annular door 220 includes slots or openings 222, 224 to facilitate or enhance air flow in the light fixture assembly. The exterior slots 222 can be substantially aligned with the outward corrugations 202*a*. Air can flow into the fixture housing 200 through the exterior slots 222. The interior slots 224 can be substantially aligned with the inward corrugations 202*b*. Air can flow out of the fixture housing 200 through the interior slots 224. This circulation of air can facilitate or enhance cooling of the light fixture assembly 100. For example, hot air can be exhausted from the fixture housing 200 through the series of interior slots 224 in the annular door 220. The interior slots 224 can be offset from the exterior slots 222, and can be positioned in alignment with flow through slots 111 in the perimeter of the optic assembly 110. The inward corrugations 202*b* of the fixture housing 200, along with the geometry and radial finning 113 of the optic assembly 110 can be configured to guide the flow of hot air from the interior of the fixture housing 200. Cool air can enter into the fixture housing 200 through exterior slots 222 in the annular door 220. The exterior slots 222 can be substantially aligned with the outward corrugations 202*a* in the fixture housing 200.

In some embodiments, the optic assembly 110 includes radial fins 113 to enhance the transfer of heat to the flowing air. In certain implementations, both the optic assembly 110 and the annular door 220 are coated with a heat dissipative compound to enhance heat transfer out of the light fixture assembly 100.

Figure 3:
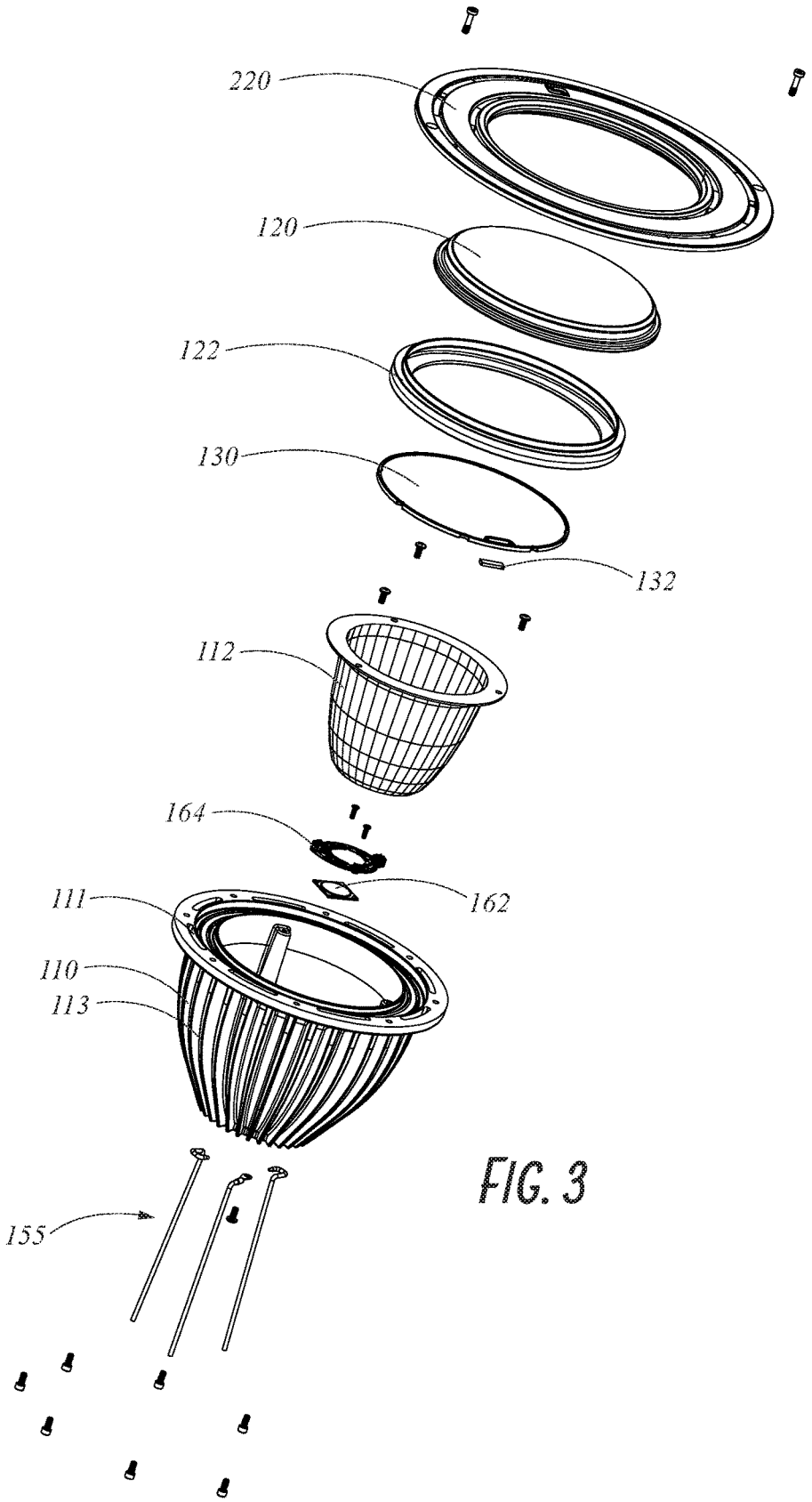
FIG. 3 illustrates an exploded view of an example optic assembly with rotatable tilt optics and slots in the example optic assembly for improved air flow.

FIG. 3 illustrates an exploded view of an example optic assembly 110 with rotatable tilt optics 130 and slots 111 in the optic assembly 110 for improved air flow. The optic assembly 110 can include radial fins 113 to enhance the transfer of heat from the optic assembly 110 to air flowing out through the flow through slots 111.

The optic assembly 110 can be coupled to a reflector 112 that is positioned within the optic assembly to redirect, focus, collimate, or otherwise shape light from a light source 162, such as an LED or LED array. The light source 162 is attached to the optic assembly 110 using a light source holder 164. Electrical power can be delivered to the light source 162 and other electrical components through the use of electrical cables 155.

Tilt optics 130 are positioned above the reflector 112 to redirect the light reflected from the reflector and/or provided directly by the light source 162. The tilt optics 130 can be attached to an aiming magnet 132. The aiming magnet 132 can be used to rotate the tilt optics 130 to change the direction of the beam of light leaving the optic assembly.

Optical element 120 can be positioned above the tilt optics 130. The optical element 120 can be configured to have an optical power (e.g., a lens) or no optical power (e.g., a transparent or semi-transparent window). The optical element 120 can be attached to an annular door 220 that is positioned above the optic assembly 110, wherein there is a sealing gasket 122 between the optical element 120 and the annular door 220. At least a portion of the annular door 220 can overlap and be in contact with a portion of the optic assembly 110. The contact between the optic assembly 110 and the annular door 220 can facilitate or enhance conduction of heat away from the optic assembly 110 into the environment from the annular door 220.

Example Light Fixture with Hot-Aiming Functionality

Figure 4:
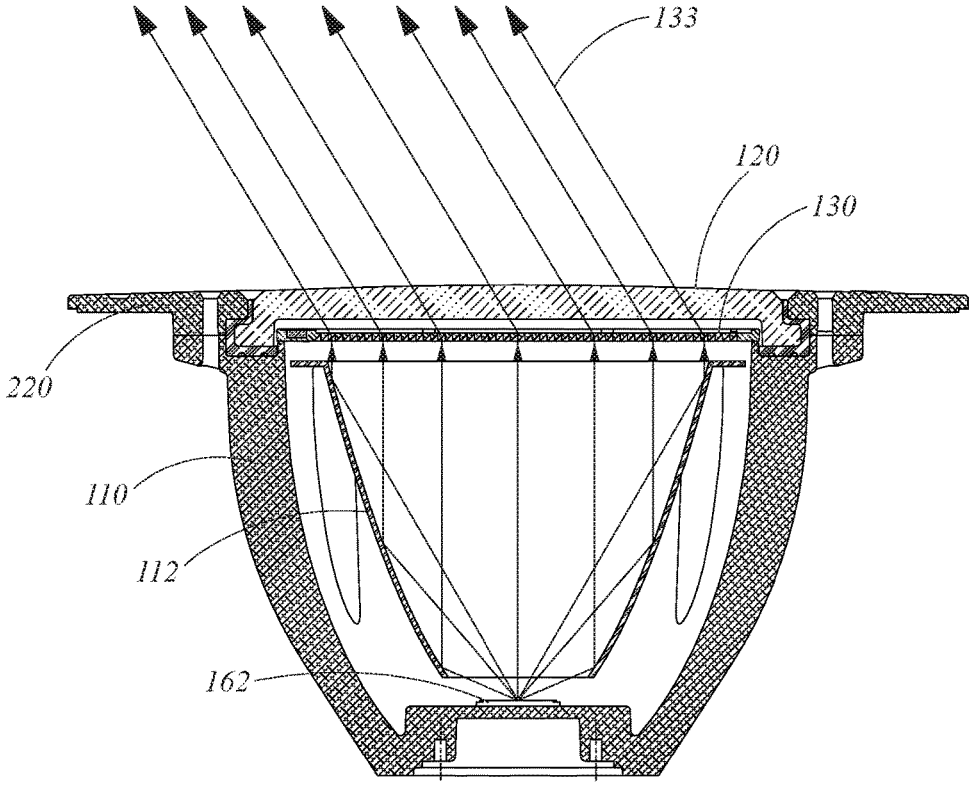
FIG. 4 illustrates a cross-sectional side view of an example optic assembly with a reflector and tilt optics.

FIG. 4 illustrates a cross-sectional side view of an optic assembly 110 with a reflector 112 and tilt optics 130. Light is provided by a light source 162, such as an array of LEDs, and the light source 162 can be controlled by control electronics (not shown) such, as an LED driver module. The optic assembly 110 can include an optical element 120 as well as the tilt optics 130 to produce a light beam with targeted characteristics. The light from the light source 162 can be reflected or redirected by the reflector 112 to the tilt optic 130 and the optical element 120. The tilt optic 130 can be configured to bend the light in a direction to provide an angled light beam 133. The orientation of the tilt optic 130 can be changed to change the direction of the angled light beam 133.

In some embodiments, the tilt optic 130 can be mounted under the optical element 120 without being in contact with the optical element 120. The tilt optic 130 can be positioned on the optic assembly 110 so that the optic assembly 110 supports the tilt optic 130 while allowing the tilt optic 130 to freely rotate. This can allow the tilt optic 130 to rotate to change the light output beam direction.

In some implementations, the reflector 112 is configured to substantially collimate the light incident thereon. The tilt optic 130 can be configured to substantially uniformly bend this collimated light to output an, angled light beam 133. In some embodiments, the optical element 120 can be configured to introduce divergence into the light beam so that the light beam spreads out with distance from the optic assembly. In certain implementations, any one of the reflector 112, tilt optics 130, and/or optical element 120 can be configured to contribute to shaping the beam of light to provide a targeted light beam from the optic assembly 110. In some embodiments, the reflector 112, tilt optics 130, and/or optical element 120 can include thin films, filters, or other optical components that alter the characteristics of the light beam.

In some implementations, the light source 162 utilizes chip-on-board (COB) LED technology and precision optics (e.g., the optical element 120 and the tilt optics 130) to achieve targeted distributions of various light beam spreads with controlled cutoff. In certain implementations, different light distributions can be provided with outputs of more than about 3000 delivered lumens in color temperatures ranging from 3000 K to 5000 K. The light beam can have varying spreads due at least in part to the combination of the optical properties of the reflector 112, the tilt optics 130, and the optical element 120. For example, the light beam can have a beam spread of less than or equal to about 10 degrees, between about 10 degrees and about 18 degrees, between about 18 degrees and about 29 degrees, between about 29 degrees and about 46 degrees, between about 46 degrees and about 70 degrees, between about 70 degrees and about 100 degrees, between about 100 degrees and about 130 degrees, greater than or equal to about 130 degrees, or any range between any of these values. The beam spread can be symmetrical or it can have a different spread along one axis and another spread along an orthogonal axis (e.g., horizontal and vertical spreads can differ). In some embodiments, beam spread is measured as the angular spread from the primary optical axis where the light intensity is about 10% of the maximum output light intensity. In some embodiments, the optical element 120 and/or the tilt optics 130 can include louvers, diffraction gratings, beam spreaders, mirrors, prisms, or the like.

Figure 5A:
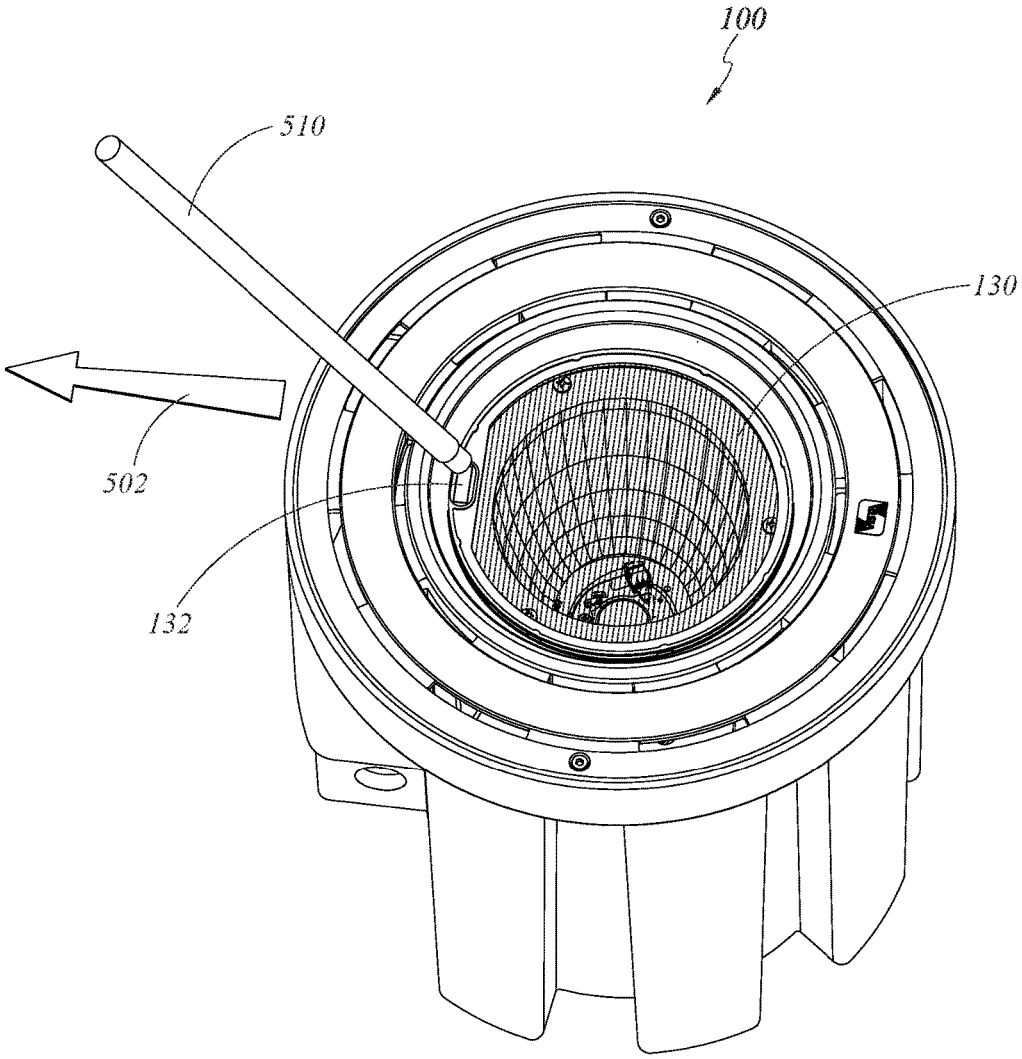
FIGS. 5A and 5B illustrate rotating tilt optics of an example light fixture with an external magnetic wand to change a direction of a beam provided by the light fixture.
Figure 5B:
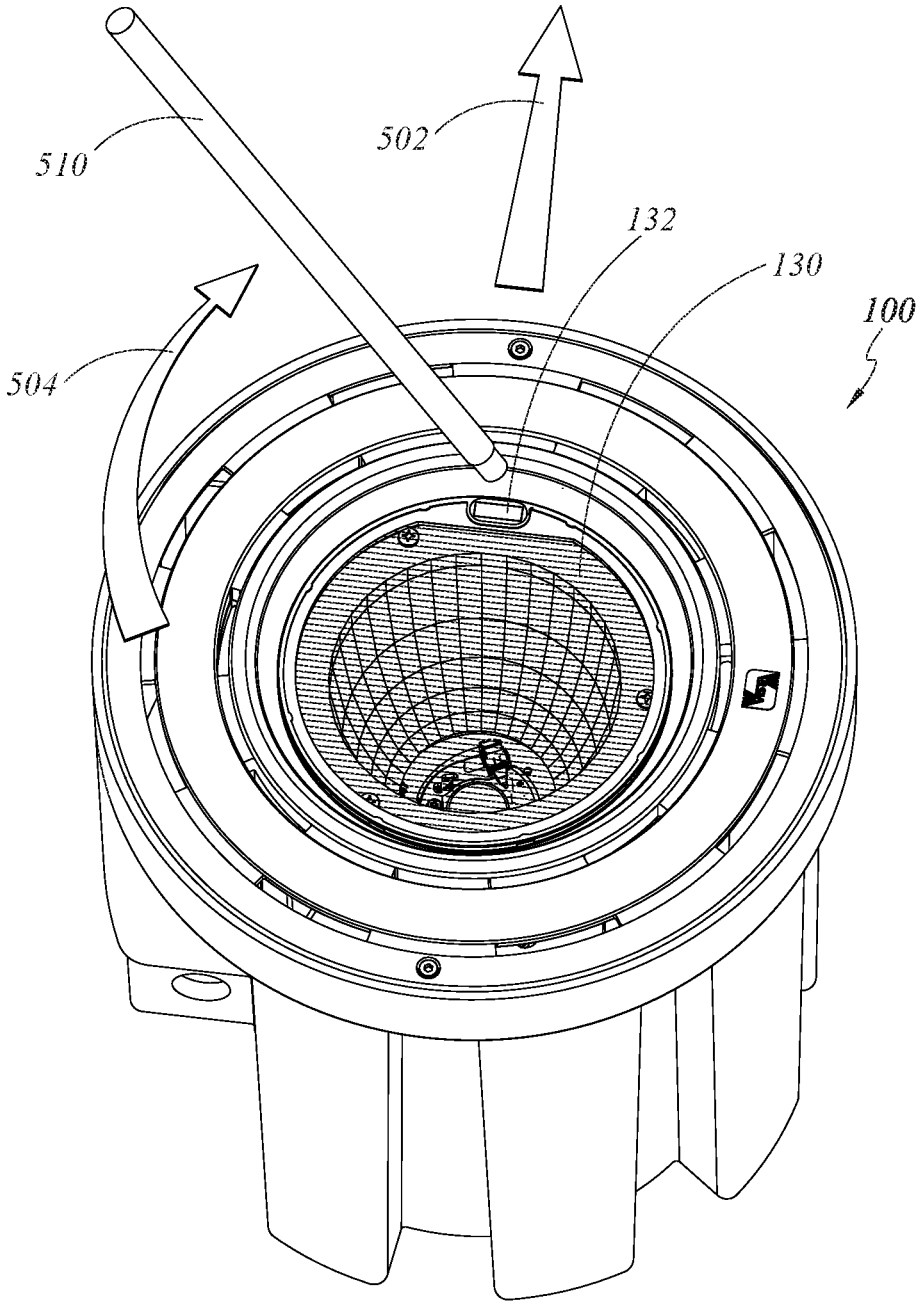

FIGS. 5A and 5B illustrate rotating tilt optics 130 of a light fixture 100 with an external instrument 510, such as a magnetic wand, to change a direction 502 of a beam provided by the light fixture 100 without opening the fixture. The transition from FIG. 5A to FIG. 5B involves applying an external magnetic force using the external instrument 510 in proximity to an aiming magnet 132 that is affixed to the tilt optic 130. The external instrument 510 and the aiming magnet 132 are designed such that bringing the external instrument 510 in proximity to the aiming magnet 132 will result in sufficient force to allow the internal tilt optic 130 to be rotated 504 within the light fixture 100 without opening the fixture. This rotation creates an "aiming" of the light distribution where the beam direction 502 can be rotated anywhere (e.g., it can be rotated 360 degrees). Once the light beam is aimed, the external instrument 510, such as a handheld magnetic wand, can be moved away from the light fixture assembly 100 so that the tilt optic 130 remains in the configured position. This configuration allows for the direction of the output light beam to be changed without opening the light fixture assembly 100 and/or without turning off the light source. This can sometimes be referred to as "hot aiming."

Figure 6A:
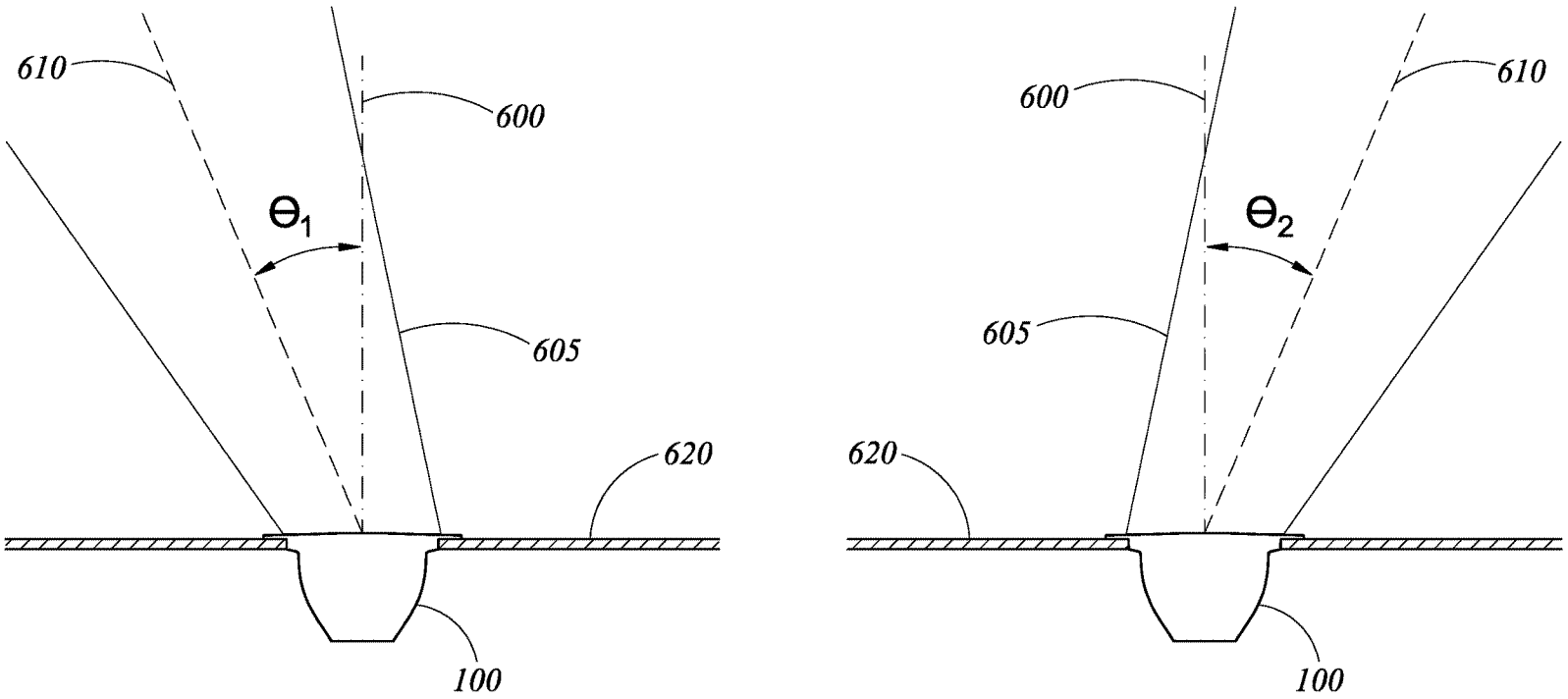
FIGS. 6A and 6B illustrate a beam of light provided by an example light fixture with rotatable tilt optics that has been rotated as described with respect to FIGS. 5A and 5B.
Figure 6B:
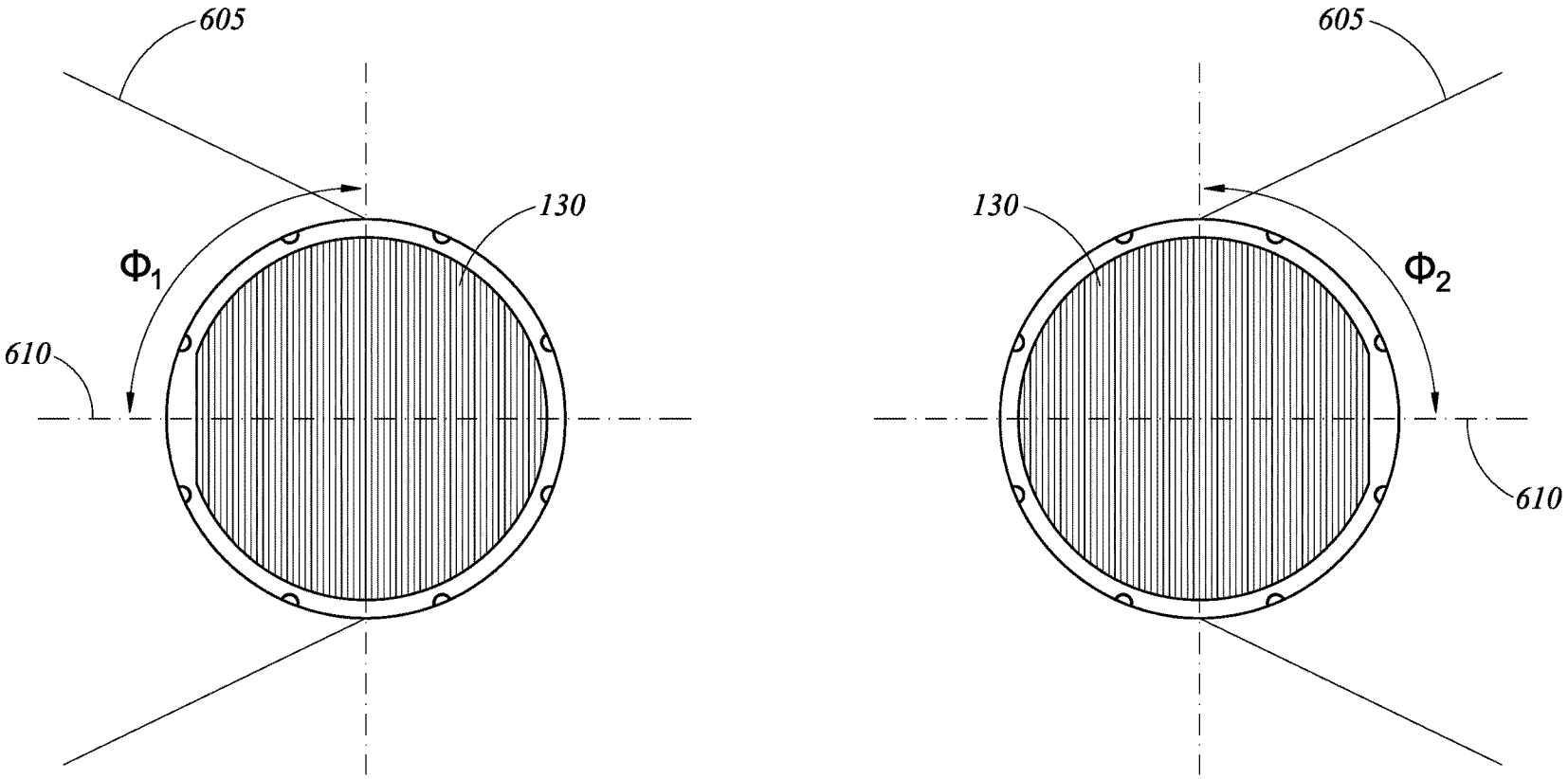

FIGS. 6A and 6B illustrate a beam of light provided by an example light fixture 100 installed in the ground 620 with rotatable tilt optics 130 that has been rotated in a manner that is similar to the rotation described with respect to FIGS. 5A and 5B. FIG. 6A provides a side view of the light fixture 100 before being rotated (the left-hand illustration) and after being rotated (the right-hand illustration). Similarly, FIG. 6B provides a top-down view of the light fixture 100 before being rotated (the left-hand illustration) and after being rotated (the right-hand illustration). In this example, the light beam is rotated 180 degrees (e.g., the total change in azimuth angle from $\phi 1$ to $\phi 2$ is 180 degrees), wherein the rotation is measured in the horizontal plane (e.g., an azimuth angle). The light beam is tilted at an angle by the tilt optics 130, where the angle from the vertical 600 (e.g., a zenith angle) is respectively equal to $\theta 1$ and $\theta 2$ (where $\theta 1 = \theta 2$). If the light fixture 100 itself is tilted (e.g., installed at an angle), then the line 600 represents the primary optical axis of the light beam in the absence of the tilt optics 130. The lines 605 represent the extent of the light beam. In FIG. 6B, the primary optical axis 610 is rotated 180 degrees to illustrate that the tilt optics 130 can be rotated in a horizontal plane to provide a targeted or desired light output.

Figure 7:
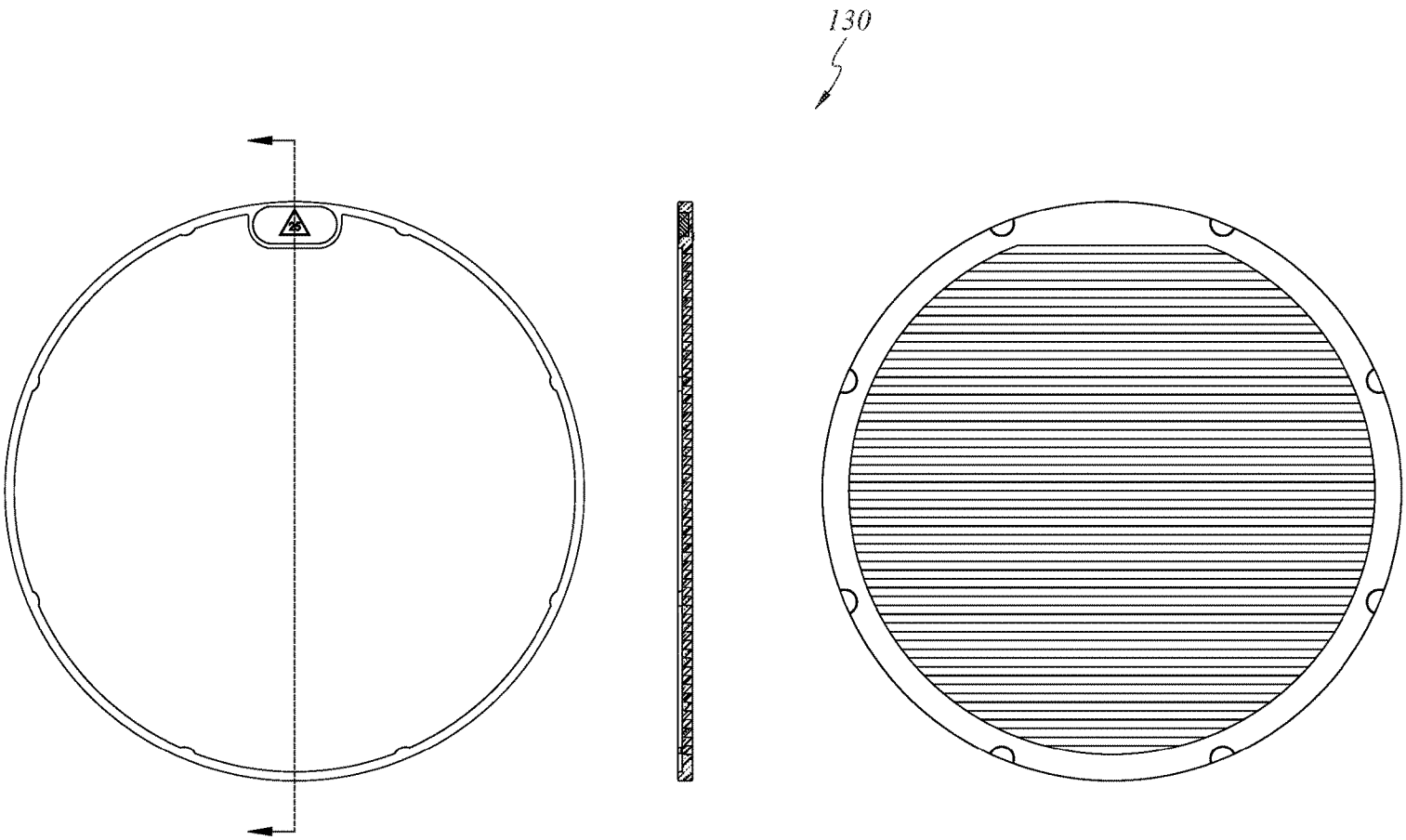
FIG. 7 illustrates views of example rotatable tilt optics.

FIG. 7 illustrates views of rotatable tilt optics 130. The tilt optics 130 can include features configured to bend incident light in a targeted direction. In some embodiments, the tilt optics 130 are configured to bend incident light uniformly across the surface of the tilt optic 130. In some embodiments, the tilt optics 130 are configured to bend incident light differently depending on the location of the incident light on the surface of the tilt optics 130. This can, be done, for example, to introduce convergence and/or divergence into the light beam. The tilt optics 130 can include angled features within the body of the tilt optics 130 to selectively bend incident light. In some embodiments, the tilt optics 130 can include a series of tilt optic lenses to bend light that passes through the tilt optics 130.

The light fixtures described herein can be configured to use tilt optics 130 to provide targeted performance characteristics. For example, a 5-degree tilt optic 130 can be used in a light fixture 100 to provide a slight angle to the outgoing light. The tilt optic 130 can be configured to bend light less than or equal to about 10 degrees, less than or equal to about 20 degrees, or less than or equal to about 25 degrees. Additionally, diffraction gratings, beam spreaders, diffusion films, and/or color filters can be positioned on top of the tilt optics 130 to further modify the pattern of the light beam emitted. In some implementations, different tilt optics 130 can be alternately used to provide different light bending characteristics. This can expand the potential optical capabilities of the light fixture through changing only the tilt optics 130.

Figure 8A:
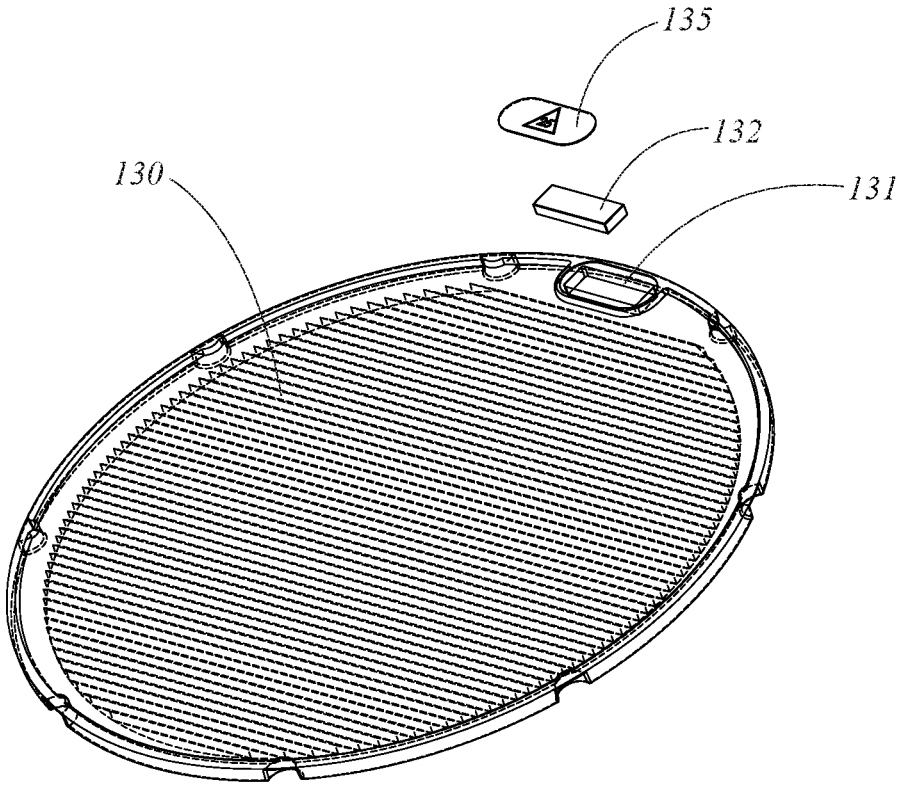
FIGS. 8A-8B illustrate example embodiments of an aiming magnet and an alignment indicator of example rotatable tilt optics.
Figure 8B:
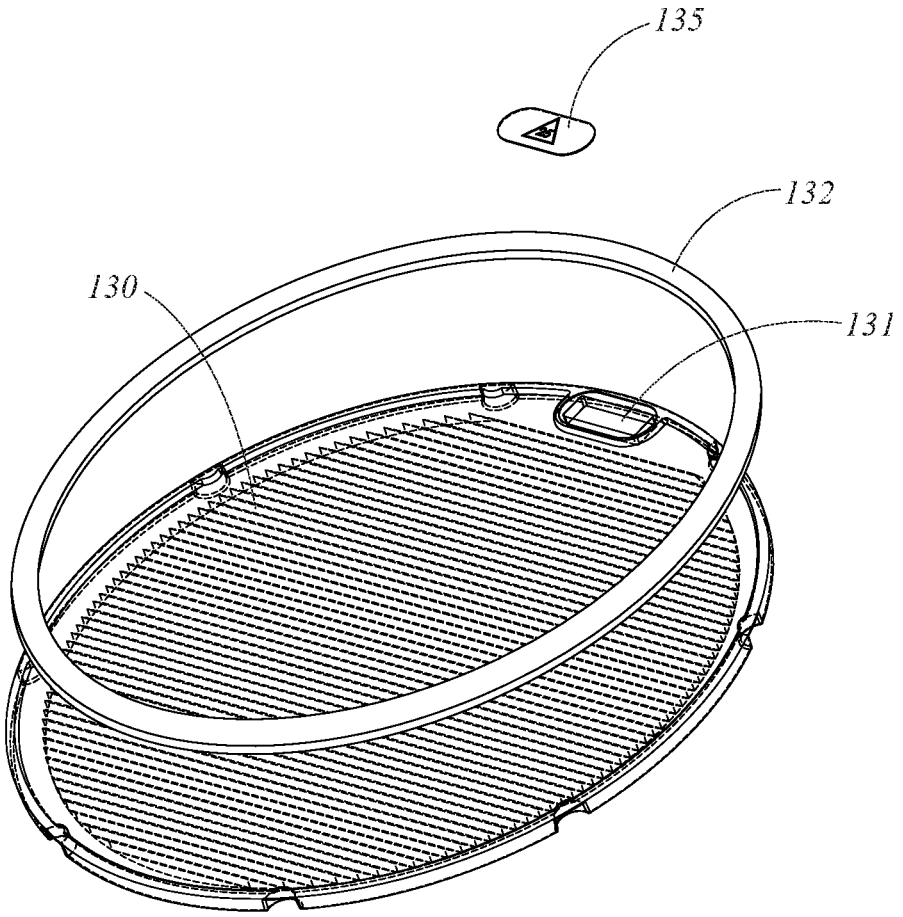

FIGS. 8A and 8B illustrate examples embodiments of an aiming magnet 132 and an alignment indicator 135 of the rotatable tilt optics 130 illustrated in FIG. 7. The aiming magnet 132 can, be a permanent magnet attached to the tilt optics 130. For example, the aiming magnet 132 can be seated in magnet seating 131 of the tilt optics 130. In some embodiments, there can be more than one aiming magnet 132 positioned at different points on the tilt optics 130, such as along a periphery of the tilt optics 130. In certain implementations the aiming magnet can extend around a periphery of the tilt optics to facilitate engagement of an external magnet used to rotate the tilt optics. In certain implementations, as illustrated in FIG. 8B, the periphery of the tilt optics 130 can comprise an annular aiming magnet 132, such as a magnetic ring that is completely magnetized. The annular aiming magnet 132 facilitates contact between the external instrument handled by a user (e.g., external wand) and the aiming magnet. As long as the external instrument is placed in the vicinity of the periphery of the tilt optics 130 such that the external instrument is in proximity to any part of the annular aiming magnetic 132, a magnetic force sufficiently strong can be generated to rotate the tilt optics 130. This implementation is especially useful when adjusting the beam while the light source is on. In, some implementations, the aiming indicator 135 can be used as a visual indication of the bending direction of the tilt optics 130.

Figure 9:
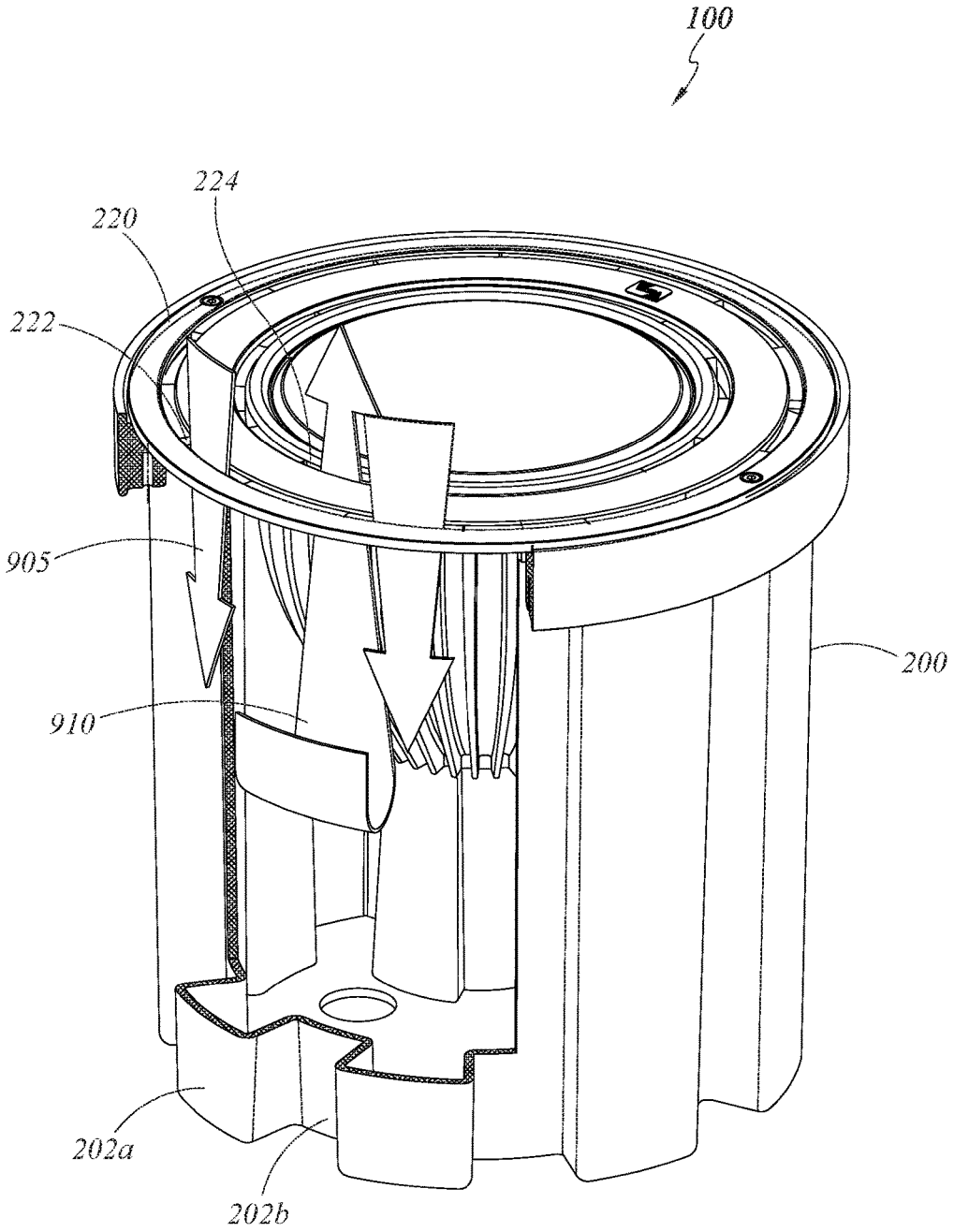
FIG. 9 illustrates air flow of an example light fixture with a corrugated fixture housing and slotted annular door.

Example Light Fixture with a Corrugated Housing and Flow Through Openings to Enhance Air Flow FIG. 9 illustrates air flow of an example light fixture 100 with a corrugated fixture housing 200 and slotted annular door 220. As described elsewhere herein, the annular door 220 includes exterior slots 222 and interior slots 224 to enhance air flow through the light fixture 100. The exterior slots 222 can be substantially aligned with outward corrugations 202*a* of the fixture housing 200 and the interior slots 224 can be substantially aligned with inward corrugations 202*b* of the fixture housing 200. In addition, the interior slots 224 can coincide with flow through openings on an optic assembly, as described herein with reference to FIG. 10.

The combination of the exterior slots 222 and the outward corrugations 202*a* can allow cool air from the environment to enter into the fixture housing 200, as illustrated by the arrow 905. The combination of the interior slots 224 and the inward corrugations 202*b* can allow hot air to exhaust from the fixture housing, as illustrated by the arrow 910. This allows a conductive cooling flow to be created and maintained within the fixture housing 200 during operation. This can improve cooling of the light source and control electronics (e.g., LED and LED module) to reduce the likelihood of damage to these components from overheating.

In addition to facilitating air-cooling inflow and hot exhausted air outflow, the corrugations 202 of the fixture housing 200 can be configured to provide significant load strength to the light fixture 100. Thus, some embodiments of the light fixtures 100 described herein can be configured for use as recessed in-grade lighting where vehicles drive over the fixtures.

Figure 10:
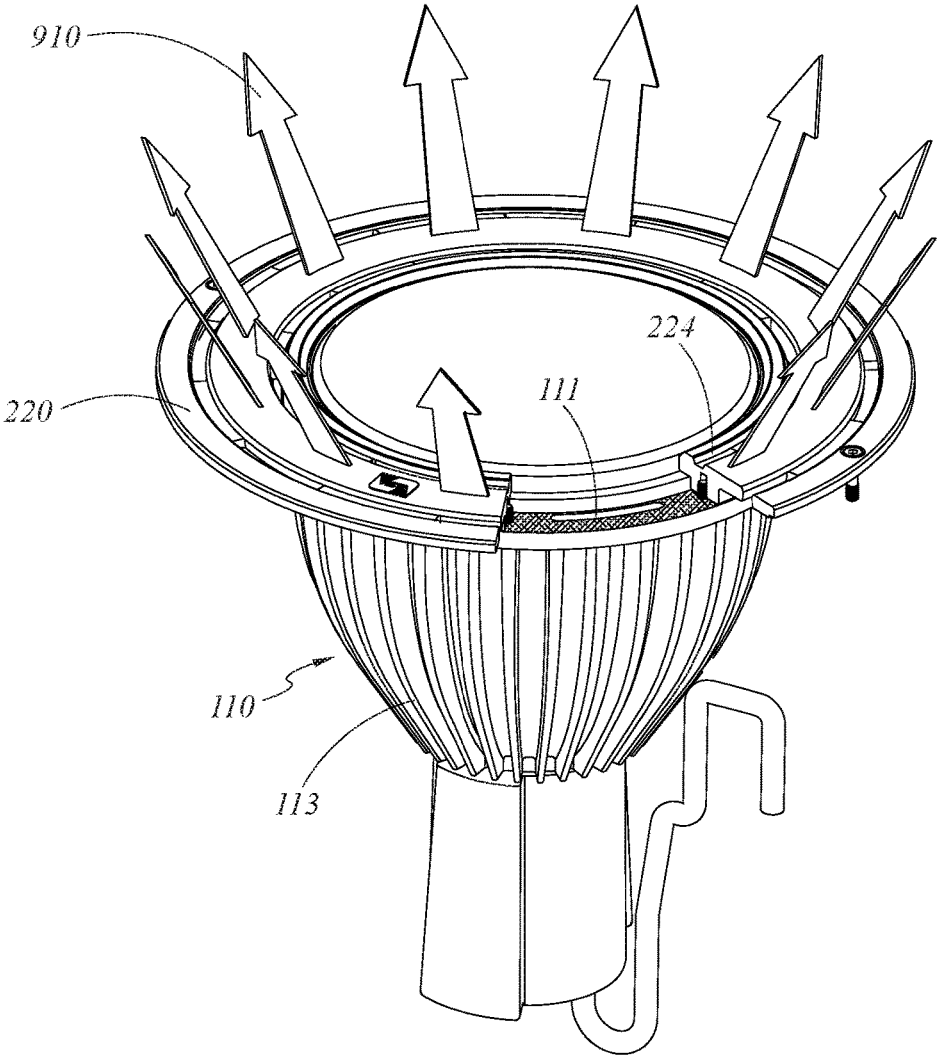
FIG. 10 illustrates outgoing air flow around an example optic assembly with a slotted annular door.

FIG. 10 illustrates outgoing air flow around an optic assembly 110 with a slotted annular door 220 positioned at a proximal end of the optic assembly 110. The optic assembly 110 includes flow through openings 111 that coincide at least partially with interior slots 224 of the annular door. This is shown using an illustrated cut-away of the annular door in FIG. 10. Hot air can be exhausted through the flow through openings and interior slots 224 to remove heat from the fixture, as illustrated by arrows 910. To improve the transfer of heat from the optic assembly 110 to the air flowing in the light fixture, the optic assembly 110 can include radial fins 113 to increase the surface area of the optic assembly in contact with the air.

Example Corrugated Housing of a Light Fixture

Figure 11:
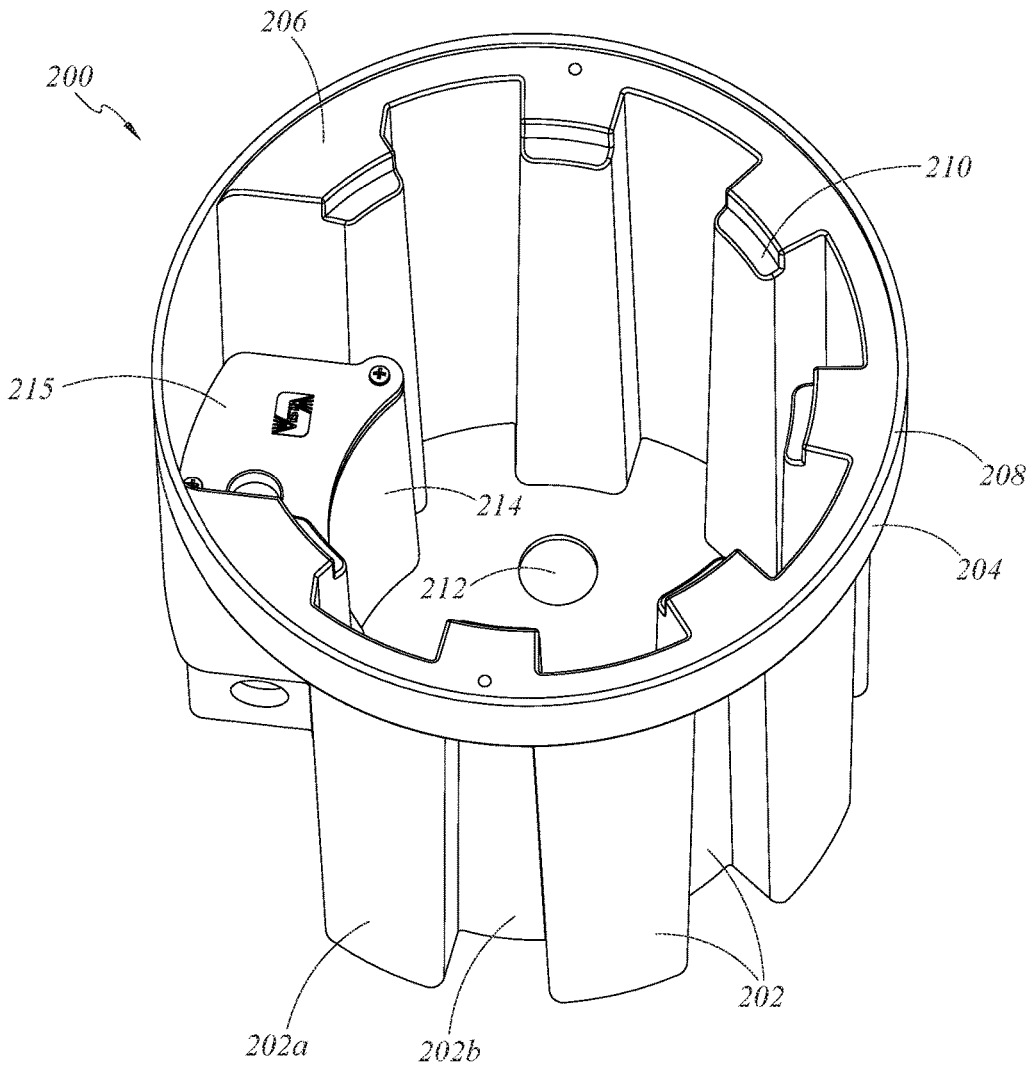
FIG. 11 illustrates a perspective view of an example corrugated fixture housing.

FIG. 11 illustrates a perspective view of a corrugated light fixture housing 200. The fixture housing 200 includes corrugations 202 including outward corrugations 202*a* and inward corrugations 202*b*. The corrugated external geometry of the fixture housing 200 can be configured to enhance the structural integrity of the light fixture. Corrugations 202 can be configured to increase loading of the fixture housing 200 in drive-over applications while creating pathways for cool air to enter into the housing 200 and hot air to exhaust from the housing 200 without the need for partitioning flues.

The fixture housing 200 includes door support 204 configured to mechanically support an annular door. The door support 204 includes a horizontal surface or door seating 206 on which the annular door rests and a door support lip 208. As a result, the annular door sees little or no bending when a load is applied to the fixture.

The fixture housing 200 includes optic assembly support 210 comprising horizontal lands configured to support an optic assembly installed in the fixture housing 200. When installed, an optic assembly seats itself on structurally supportive housing lands 210. Vertical walls of structurally supportive housing are loaded in compression when a heavy force is applied, such as in drive-over applications. The length of the vertical corrugated walls 202 can be configured to increase total fixture load bearing capabilities.

The fixture housing 200 includes holes 212 in the bottom of the fixture housing 202 to allow water to pass through. The fixture housing 200 includes an integrally molded junction box 214 with a lid 215 to provide environmental protection to electrical supply service or signals. The fixture housing 200 can be configured to be used in wet locations, indoors, and/or outdoors.

Conclusion and Terminology

The embodiments described herein are exemplary. Modifications, rearrangements, substitutions, etc. may be made to these embodiments and still be encompassed within the teachings set forth herein. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or components. Thus, such conditional language is not generally intended to imply that features, elements and/or components are in any way required for one or more embodiments. The terms "comprising," "including," "having," "involving," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y or Z," unless specifically stated otherwise, is otherwise understood with the context as used in general to present that an item, term, etc., may be either X, Y or Z, or any combination thereof (e.g., X, Y and/or Z). Thus, such disjunctive language is not generally intended to, and should not, imply that certain embodiments require at least one of X, at least one of Y or at least one of Z to each be present.

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a result (e.g., measurement value) is close to a targeted value, where close can mean, for example, the result is within 80% of the value, within 90% of the value, within 95% of the value, or within 99% of the value.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations.

While the above detailed description has shown, described, and pointed out novel features as applied to illustrative embodiments, it will be understood that various omissions, substitutions, and changes in the form and details of the devices or algorithms illustrated can be made without departing from the spirit of the disclosure. As will be recognized, certain embodiments described herein can be embodied within a form that does not provide all of the features and benefits set forth herein, as some features can be used or practiced separately from others. All changes which come within the meaning and range of equivalency of the claims are to be embraced within their scope.

What is claimed is:

1. A light fixture comprising:

a fixture housing comprising a door support and an optic assembly support;

an annular door supported by the door support of the fixture housing;

an optic assembly comprising a reflector and a light source, the optic assembly supported by the optic assembly support of the fixture housing, the light source being positioned at a distal end of the optic assembly and configured to provide a light beam that is at least partially shaped and redirected by the reflector;

a rotatable tilt optic comprising an aiming magnet attached thereto, the rotatable tilt optic supported by a proximal portion of the optic assembly such that at least a majority of the light beam provided by the light source passes through the rotatable tilt optic; and an optical element supported by the annular door such that at least a majority of the light beam that passes through the rotatable tilt optic passes through the optical element as well, wherein application of a magnetic force to the aiming magnet causes the rotatable tilt optic to rotate within the light fixture to change an angle of the light beam exiting the light fixture without opening the light fixture.

2. The light fixture of claim 1, wherein the rotatable tilt optic further comprises an aiming indicator to indicate a direction of the light beam exiting the light fixture.

3. The light fixture of claim 1, wherein the aiming magnet extends at least partially around a periphery of the rotatable tilt optics.

4. The light fixture of claim 1, wherein the rotatable tilt optics is configured to rotate 360 degrees within the light fixture.

5. The light fixture of claim 1, wherein, the fixture housing comprises corrugations configured to provide structural integrity to the light fixture.

6. The light fixture of claim 1, wherein the fixture housing comprises corrugations configured to facilitate air flow through the light fixture.

7. The light fixture of claim 6, wherein the annular door includes exterior slots substantially aligned with outward corrugations of the fixture housing to facilitate ingress of air from the environment into the fixture housing.

8. The light fixture of claim 7, wherein the annular door includes interior slots substantially aligned with inward corrugations of the fixture housing to facilitate egress of air from the fixture housing into the environment.

9. The light fixture of claim 8, wherein the optic assembly includes flow through openings substantially aligned with the interior slots of the annular door to facilitate egress of air from the fixture housing into the environment.

10. The light fixture of claim 1 further comprising control electronics in an enclosure in thermal contact with the optic assembly, the control electronics being thermally insulated from the optic enclosure.

11. A light fixture comprising:

a fixture housing comprising:

inward corrugations;

outward corrugations;

a door support; and an optic assembly support;

an annular door supported by the door support of the fixture housing, the annular door comprising exterior slots substantially aligned with the outward corrugations of the fixture housing and interior slots substantially aligned with the inward corrugations of the fixture housing;

an optic assembly supported by the optic assembly support of the fixture housing, the optic assembly comprising:

flow through openings substantially aligned with the interior slots of the annular door;

a reflector; and a light source; and an optical element supported by the annular door, wherein cooling of components of the optic assembly is provided by air flowing into the light fixture through the exterior slots of the annular door and out through the interior slots of the annular door.

12. The light fixture of claim 11, wherein the optic assembly further comprises a rotatable tilt optic, said rotatable tilt optic comprising an aiming magnet attached thereto, the rotatable tilt optic supported by a proximal portion of the optic assembly.

13. The light fixture of claim 12, wherein application of a magnetic force to the aiming magnet causes the rotatable tilt optic to rotate within the light fixture to change an angle of a light beam exiting the light fixture without opening the light fixture.

14. The light fixture of claim 12, wherein the rotatable tilt optic further comprises an aiming indicator to indicate a direction of the light beam exiting the light fixture.

15. The light fixture of claim 12, wherein the aiming magnet extends at least partially around a periphery of the rotatable tilt optic.

16. The light fixture of claim 11, wherein the optic assembly further comprises radial fins to increase heat transfer to air flowing through the light fixture.

17. The light fixture of claim 11, wherein the optic assembly is in thermal contact with the annular door such that heat is conducted from the optic assembly to the annular door.

18. The light fixture of claim 11, wherein the inward corrugations and the outward corrugations extend substantially the entire length of the fixture housing from the door support to a distal end of the fixture housing.

19. The light fixture of claim 18, wherein the inward corrugations and the outward corrugations are configured to provide structural integrity to the light fixture sufficient to withstand a vehicle driving over the light fixture when installed in the ground.

20. The light fixture of claim 11 further comprising control electronics in an enclosure in thermal contact with the optic assembly, the control electronics being thermally insulated from the optic enclosure.

* * * * *